United States Patent [19]

Douglas

[11] Patent Number: 4,977,828

[45] Date of Patent: Dec. 18, 1990

[54] TRANSFER ROLLER DEVICE FOR PRINTING PRESSES

[75] Inventor: David D. Douglas, Garland, Tex.

[73] Assignee: Printing Research, Inc., Dallas, Tex.

[21] Appl. No.: 390,379

[22] Filed: Aug. 7, 1989

[51] Int. Cl.[5] ..... B41F 9/00

[52] U.S. Cl. ..... 101/142; 101/420; 29/132; 271/204

[58] Field of Search ..... 101/142, 416.1, 417, 101/422; 29/123, 129.5, 131, 132; 271/204, 82

[56] References Cited

U.S. PATENT DOCUMENTS

| | | | |
|---|---|---|---|
| 2,085,845 | 7/1937 | Binkley | 101/420 |
| 3,334,892 | 8/1967 | Janecek et al. | 101/420 |
| 3,602,140 | 8/1971 | Sudduth | 101/420 |
| 3,710,470 | 1/1973 | Krake | 29/131 |
| 3,780,925 | 12/1973 | Ternes | 101/420 |
| 4,028,783 | 6/1977 | Buck | 101/422 |
| 4,060,238 | 11/1977 | Simeth | 101/420 |
| 4,098,631 | 7/1978 | Stryjewski | 29/132 |
| 4,722,276 | 2/1988 | Tyler | 101/419 |

FOREIGN PATENT DOCUMENTS

| | | | |
|---|---|---|---|
| 288851 | 1/1967 | Australia | 29/132 |
| 0059944 | 9/1982 | European Pat. Off. | 101/420 |

*Primary Examiner*—Eugene H. Eickholt

*Attorney, Agent, or Firm*—Kelly, Bauersfeld & Lowrey

[57] ABSTRACT

A roller transfer device for use in sheet fed rotary printing presses of the type employing a one and one half to one delivery system, the transfer device comprising a frame mounted to a drive shaft adjacent the press impression cylinder, and supporting diametrically disposed fabric covered rollers arranged to engage and support a printed sheet during transfer from the impression cylinder to a further processing station within the press.

23 Claims, 3 Drawing Sheets

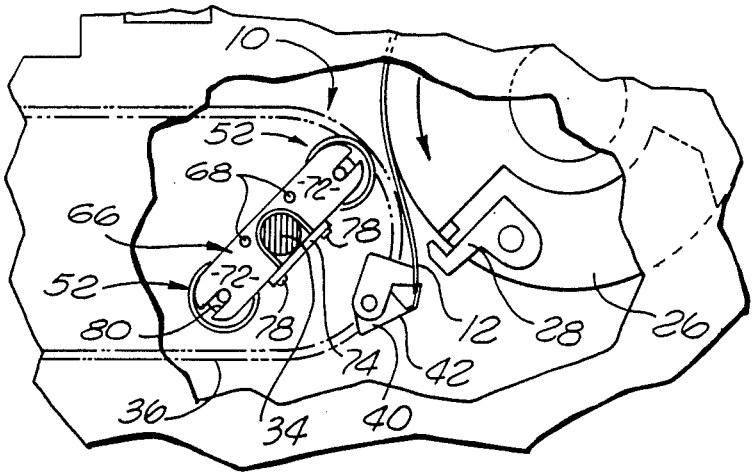
FIG. 3
FIG. 4
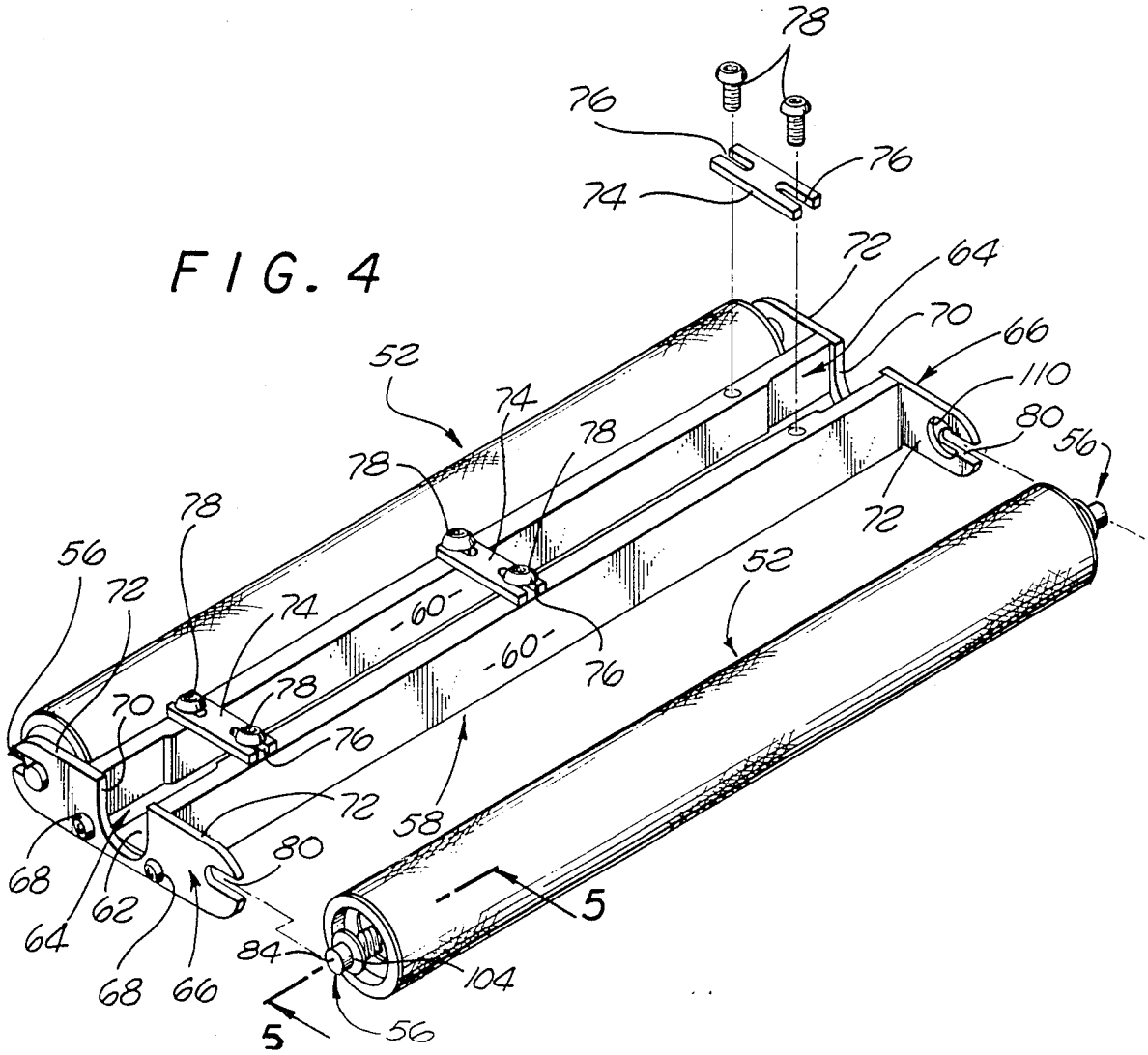

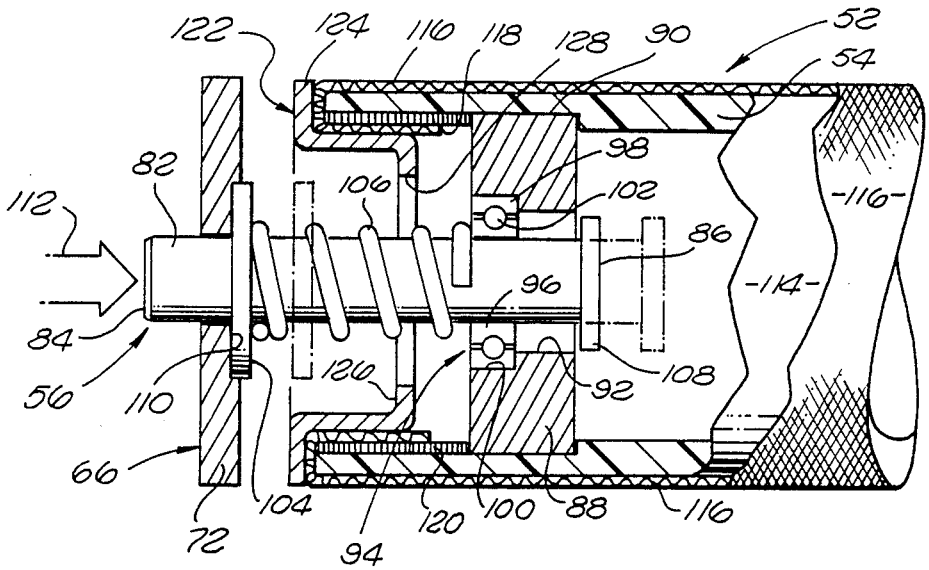
FIG. 5
FIG. 6
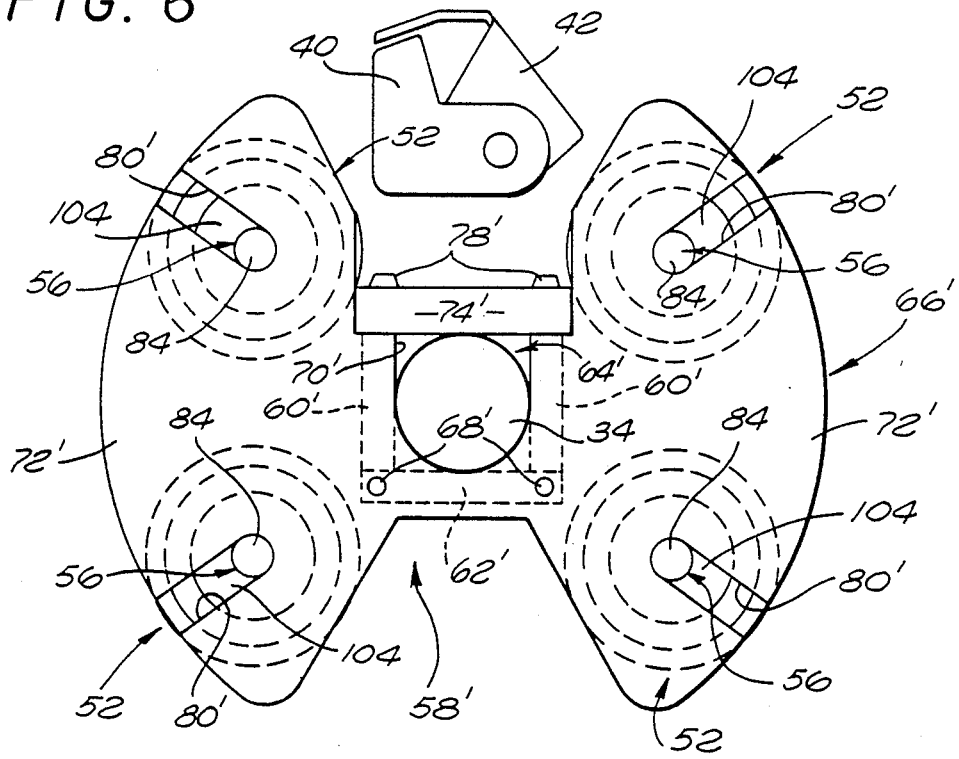

TRANSFER ROLLER DEVICE FOR PRINTING PRESSES

BACKGROUND OF THE INVENTION

This invention relates to sheet fed, off-set rotary printing presses of the type having a one and one half to one delivery system, and more particularly to a new and improved transfer device for use in the delivery system of such presses.

In a sheet fed, off-set rotary printing press, it is necessary that the wet ink side of a freshly printed sheet be supported during transfer of the sheet from the press impression cylinder to either a press delivery station or to another printing station within the press. To effect the transfer from the impression cylinder, most off-set printing presses employ a delivery system which includes a chain conveyor carrying a gripper bar assembly having sheet grippers which grip the leading edge of the sheet and pull the sheet from the impression cylinder around a transfer device which typically includes skeleton wheels, drums, cylinders or other support members depending upon the type of press involved, which support the wet ink side of the sheet during the transfer.

With rotary presses having a one to one delivery system where the transfer device rotates one complete revolution during each passage of a gripper bar assembly, it has been found that a delivery system using the inventions described in U.S. Pat. Nos. 3,791,644 and 4,402,267 issued, respectively Feb. 12, 1974 and Sept. 6, 1983, to Howard W. DeMoore, can be reliably and effectively used to support the wet ink side of the printed sheet with out marking or marring the sheet. The inventions described in the foregoing DeMoore patents have received wide acceptance in the printing industry and have achieved very substantial commercial success, and transfer and delivery systems embodying those inventions are currently being manufactured and sold under license by Printing Research, Inc. of Dallas, Texas, the assignee of the present invention. Each of the foregoing patents, the disclosure of which are hereby incorporated herein by this reference, employs a wheel or drum formed as a cylinder having a cylindrical sheet support surface which is discontinuous and formed with a single longitudinally extending opening to permit the gripper bar assembly to pass around the wheel or drum adjacent the impression cylinder.

Prior to the present invention, it was not thought possible to use a wheel or drum type device such as disclosed in the above identified DeMoore patents in a rotary press employing a one and one half to one delivery system, since the transfer wheel or drum must rotate one and one half complete revolutions for each passage of a gripper bar assembly, and to provide two longitudinal openings along the drum of a size sufficient to permit the gripper bar assembly to pass through the nip between the impression cylinder and the transfer device would reduce the effective support surface of the transfer device below that required for effective sheet support without marking. Accordingly, prior to the present invention rotary presses using a one and one half to one delivery system have typically used skeleton wheels of the general types referred to as prior art in the DeMoore U.S. Pat. No. 3,791,644. Such prior art skeleton wheels typically comprise thin disc shaped wheels having a fluted or serrated rim designed to provide minimum surface area contact with the wet inked surface of the freshly printed sheet, and which typically are adjusted along their drive shaft so as to engage the sheet in an area where minimum wet ink is present. In a press having a one and one half to one delivery system, the prior art skeleton wheels are segmented so as to form two openings between rim segments to permit the gripper bar assemblies to pass around the wheel adjacent the impression cylinder.

One problem inherent in the use of prior art skeleton wheels in a one and one half to one delivery system is that the press must be stopped and the position of the skeleton wheel adjusted for each new print job being run. Further, unless the prior art skeleton wheels can be located to engage the sheet only where no wet ink is present, for example in the margins of a page, the rim of the skeleton wheel may mark or mar the printed sheet and leave "tracks" and indentations on the printed sheet.

Another problem which has been encountered with the delivery system of such a press is that the effective diameter and speed of rotation of the transfer device must be the same as those of the impression cylinder so that there will be no relative motion between the sheet leaving the impression cylinder and engaging the support surface of the transfer device. In presses having a one and one half to one delivery system, the transfer device is typically chain driven, and it is extremely difficult, if not impossible to maintain the rotational speed of the transfer device equal to that of the impression cylinder. As a result, it has been found that relative motion between the sheet and the support surface of the transfer device has caused marking and marring of the wet ink surface of the sheet.

Thus, there exists a need for a new and improved transfer device for use with the transfer or delivery system of a press having a one and one half to one delivery system which will permit the prior art skeleton wheels used with such presses to be replaced with a wheel or drum type system which can take advantage of the inventions disclosed in the above mentioned DeMoore patents so as to substantially prevent marking and marring of the printed sheet. As will become more apparent from the following, the present invention solves this need in a new and unobvious way.

SUMMARY OF THE INVENTION

The present invention provides a new and improved transfer device for use in the delivery system of a sheet fed, off-set rotary printing press of the type employing a one and one half to one delivery system for conveying freshly printed sheets from the impression cylinder to a further processing station within the press without marking or marring the wet ink. The present invention employs fabric covered rollers mounted for free rotation on a frame to a drive shaft and which can be used without requiring any press modification to replace prior art skeleton wheels in the delivery system of substantially any printing press having a one and one half to one delivery system.

The rollers are formed as continuous cylindrical shells having a friction reducing coating thereon and covered by a fabric material impregnated with a liquid repellant substance. The rollers are mounted to the frame for easy removal, and are spaced apart to permit the gripper bar assembly of the press delivery system to pass between the rollers adjacent the impression cylinder with every one and one half complete revolutions of the drive shaft.

In accordance with another feature of the invention, the fabric material is formed as a seamless cylindrical sleeve having open ends which can be quickly and easily removed and replaced over the roller shell. The fabric sleeve is attached to the rollers by end caps which clamp the open ends of the sleeve inside the ends of the shell, and the shell is mounted to the frame by spring biased stub axles which permit the cylinders to be quickly and easily removed from the frame for replacement or repair.

The transfer device of the present invention provides a new and unique method for supporting the wet ink side of a printed sheet during transfer from the impression cylinder in the delivery system of a press of the type employing a one and one half to one delivery system, and operates in a highly reliable and effective manner to prevent marking and marring of the printed sheet, yet is simple in construction and economical to manufacture. Other features and advantages of the present invention will become more apparent from the following detailed description, taken in conjunction with the accompanying drawings which illustrate, by way of example, the principles of the invention.

BRIEF DESCRIPTION OF THE DRAWINGS

FIG. 3 is an enlarged fragmentary side elevational view, partly in cross-section, showing the delivery system of the invention as used in place of the prior art skeleton wheel shown in FIG. 2;

FIG. 4 is an enlarged perspective view, partially shown in exploded form, of a roller assembly forming the delivery system of the present invention, and illustrating the assembly prior to mounting in the press of FIG. 1;

FIG. 5 is an enlarged fragmentary perspective view, partially in cut away cross-section, of one end of a roller forming part of the assembly shown in FIG. 4; and FIG. 6 is a side elevational view of a modified roller assembly of the present invention.

DETAILED DESCRIPTION OF PREFERRED EMBODIMENTS

Figure 1:
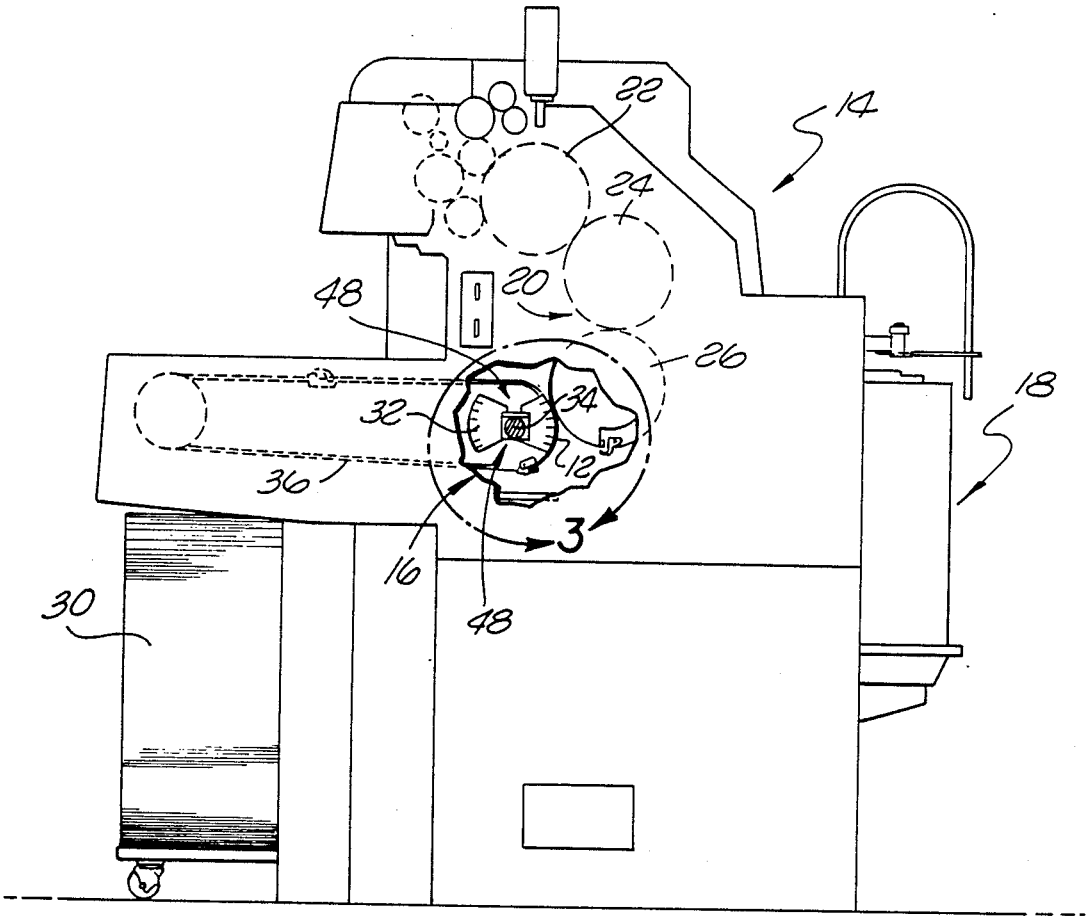
FIG. 1 PRIOR ART
FIG. 1 is a side plan view, partly in cross-section of a printing press employing a one and one half to one delivery system, and showing a prior art skeleton wheel used in the delivery system.
Figure 2:
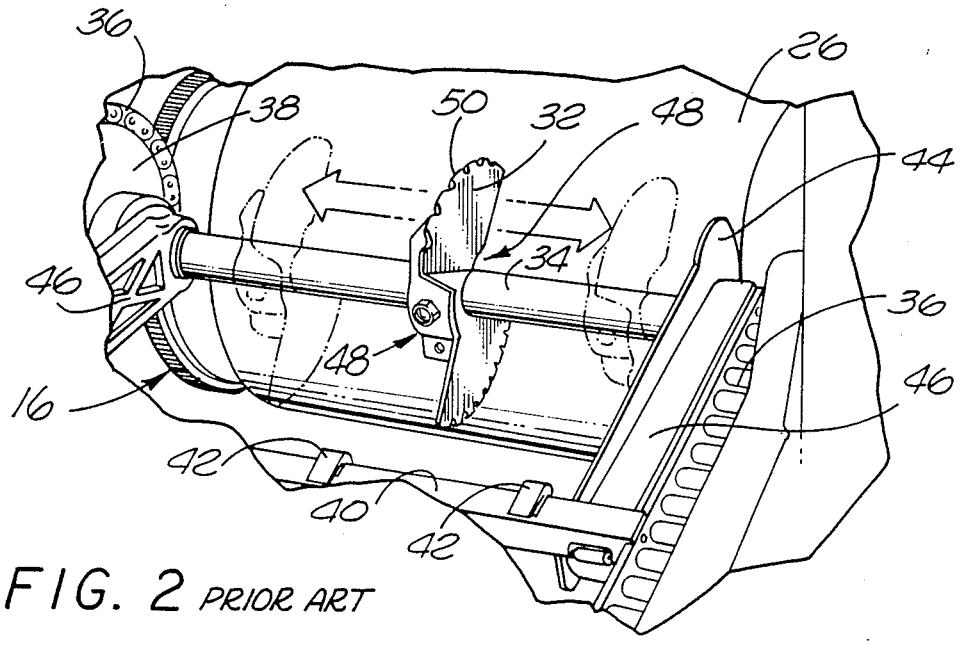
FIG. 2 PRIOR ART
FIG. 2 is an enlarged, fragmentary elevational view of the prior art skeleton wheel illustrated in FIG. 1.

As shown in the exemplary drawings, the present invention is embodied in a new and improved transfer device, generally designated in FIG. 3 by the reference numeral 10, for supporting a printed sheet 12 during transfer of the sheet by the delivery system of a sheet-fed, off-set rotary printing press 14 of the type employing a one and one half to one delivery system. In this instance, illustrated in FIGS. 1 and 2, is a conventional sheet-fed, off-set rotary press 14 such as that made by A.B. Dick, Co. under its model number 360 and which is shown with a conventional prior art one and one half to one delivery system designated generally by the reference numeral 16. The press 14, which is schematically illustrated herein for simplicity, includes a sheet feeder station 18 wherein individual sheets 12 to be printed are stacked and fed sequentially into the press, and a printing station 20 comprising a plate cylinder 22, a blanket cylinder 24, and an impression cylinder 26 having sheet grippers 28 for gripping and holding the sheet during movement through the printing station. The delivery system 16 functions to pull the freshly printed sheet 12 from the impression cylinder 26 and to convey the sheet to either another printing station or to a delivery station 30 as herein shown, where the printed sheets are stacked for removal from the press 14.

In a press 14 of the type employing a prior art one and one half to one delivery system 16, the delivery system includes a skeleton wheel 32 mounted on a rotary drive shaft 34 extending laterally across the press adjacent the impression cylinder 26, and which functions as a transfer device to support the freshly printed side of the sheet 12 during transfer of the sheet from the impression cylinder. To remove a freshly printed sheet 12 from the impression cylinder 26 and pull the sheet to the next station, the delivery system 16 has a pair of parallel endless driven conveyor chains 36 trained around sprocket wheels 38 mounted on the lateral ends of the drive shaft 34, and which carry laterally disposed gripper bars 40 having grippers 42 for gripping the leading edge of the printed sheet adjacent the impression cylinder. As shown herein, the gripper bars 40 include a conventional cam operated mechanism (not shown) for causing the grippers 42 to open and close to grip the leading edge of a sheet 12 as the gripper bar passes the impression cylinder 26. To actuate the cam operated mechanism of the grippers 42, a cam plate 44 is attached to one of a pair of laterally spaced press frame supports 46, herein the right support as seen in FIG. 2, the supports being disposed laterally inwardly of the conveyor chains 36 and serving to support the lateral end portions of the drive shaft 34 which is journaled therethrough. As the gripper bar 40 passes over the cam plate 44, the cam plate actuates the cam operating mechanism to open and close the grippers 42 at the appropriate position to grip and pull a sheet 12 from the impression cylinder 26.

The gripper bars 40 are longitudinally spaced along the conveyor chains 36 such that the drive shaft 34, and hence the sprocket wheels 38 and skeleton wheel 32, will make one and one half complete revolutions between each passage of one gripper bar 40 past the impression cylinder 26. In this manner, the drive shaft will make one and one half revolutions during transfer of each individual sheet 12 from the impression cylinder 26. A rotary press 14 having this type of delivery system is conventionally known in the printing industry as a press having a one and one half to one delivery system.

With conventional presses 14 having a prior art one and one half to one delivery system 16, it is not possible to use a cylindrical roller concentrically mounted on the drive shaft 34 such as disclosed in the before mentioned DeMoore Patent Nos. 3,791,644 and 4,402,267 since the gripper bars 40 must be able to pass around the periphery of the skeleton wheel at two diametrically spaced locations due to the one and one half to one delivery system cycle. Prior to the present invention, it was typical that prior art one and one half to one delivery systems 16 use one or more segmented skeleton wheels 32 having two diametrically opposed openings 48 for permitting the gripper bars 40 to pass around the skeleton wheel adjacent the outer periphery of the impression cylinder 26 as each sheet 12 was transferred.

In an effort to minimize marking and smearing of the freshly printed sheet 12 during transfer from the impression cylinder 26 in such prior art delivery systems 16, the segmented skeleton wheel 32 is adjustably mounted to the drive shaft 34 so that the skeleton wheel can be laterally positioned along the drive shaft as shown by the phantom line positions illustrated in FIG. 2, to attempt to place the area of contact of the skeleton wheel outer periphery on the sheet where minimum wet ink is present. Thus, for each particular printing job, the position of the skeleton wheel 32 in prior art delivery systems 16 was required to be adjusted in an attempt to minimize sheet marking and marring, thereby requiring that the press 14 be stopped between each job. In many printing situations, it is not possible to position the segmented skeleton wheel 32 in a position where it will not contact wet ink, and the sheet 12 will be marked or marred regardless of where the skeleton wheel is positioned. Moreover, in an effort to further reduce marking, prior art delivery systems 16 typically employ skeleton wheels 32 having outer peripheral edges 50 which are relatively narrow, or even sharp for reducing the area over which the skeleton wheel contacts the sheet 12. The narrow edge 50 of prior art skeleton wheels 32 have been found to cause depressions in the freshly printed surface of the sheet 12, and may cause sheet creasing or tearing due to the uneven and very small support area afforded by the outer peripheral edge of the skeleton wheel.

In accordance with a primary aspect of the present invention, the new and improved transfer device 10 eliminates the need for skeleton wheel adjustment between printing jobs, and substantially eliminates any sheet marking and marring of the freshly printed sheet 12 while providing uniform and effective support for the freshly printed sheet over substantially its full width during transfer from the impression cylinder 26 of the press 14. Further, the present invention provides a transfer device 10 which is highly reliable and effective in use, and which is relatively economical to manufacture and easy to install and maintain in place of prior art skeleton wheels 32 found in existing presses 14 without requiring any press modification.

Toward the foregoing ends, as best shows in FIGS. 2 and 4, the transfer device 10 of the present invention includes a plurality of individual rollers 52, herein two such rollers, formed as continuous cylindrical shells 54 mounted by stub axles 56 to an elongated frame 58 secured to the drive shaft 34 for rotation therewith, and which engage and support the wet ink surface of the sheet 12 across substantially the full width of the sheet. As best seen in FIG. 4, the frame 58, which preferably is made of metal, herein is formed to have a generally "C" shaped cross-section defined by generally flat parallel side walls 60 and a generally flat bottom wall 62, the side walls and bottom wall defining an elongated channel 64 dimensioned to receive the drive shaft 34. To mount the rollers 52 to the frame 58, a pair of end plates 66 are secured, herein by bolts 68, to each of the ends of the frame, the length of the frame and end plates being dimensioned to fit along the drive shaft 34 within the lateral space between the press frame supports 46.

The end plates 66 are each provided with generally "C" shaped slots 70 formed centrally therein and which are aligned with the channel 64 of the frame 58 for receiving the drive shaft 34. Each of the end plates 66 forms a pair of mounting flanges 72 which project outwardly from opposite sides of the slot 64 beyond the side walls 60 of the frame 58, and to which the stub axles 56 of the rollers 52 are coupled. For rigidly mounting the frame 58 to the drive shaft 34, a series of clamps 74, herein three in number and formed as rectangular brackets having "C" shaped openings 76 in each end through which bolts 78 extend, are secured to the frame side walls 60 over the open end of the channel 64 to securely clamp the drive shaft within the channel. With this arrangement the frame 58 and rollers 52 can be quickly and easily installed on the drive shaft 34 with out requiring any modification in the press 14.

As can best be seen in FIGS. 4 and 5, the rollers 52 are releasably mounted to the flanges 72 of the frame 58 for free rotation by the stub axles 56 which project axially from each end of each roller and which are received in elongated slots 80 formed on diametrically opposed sides of the device shaft 34 in opposed ends of the flanges so that the axis of each roller is parallel with the axis of the drive shaft 34. With particular reference to FIG. 5, the stub axle 56 at each end of the rollers 52 comprises a cylindrical shaft 82 having an outer end 84 projecting beyond the end of the shell 54, and an inner end 86 extending inside the shell, and is coupled to the shell by a support 88 herein formed as a doughnut shaped block having an outer peripheral surface 90 secured to the inner cylindrical surface of the shell, and an inner peripheral surface 92 spaced radially outwardly of the shaft. The inner end portion of each stub axle 56 is journaled to the support block 88 through a roller bearing assembly 94 comprising an inner race 96 engaged with the outer periphery of the shaft 82, an outer race 98 seated within a recess 100 formed in the inner peripheral surface 92 of the support block, and a plurality of roller bearings 102 disposed between the races to permit the shell 54 to rotate freely relative to the stub axle.

For releasably mounting the rollers 52 to the frame 58, the stub axles 56 are spring loaded so that they can be quickly and easily removed from the mounting flanges 72. Disposed inwardly of the outer end 84 of the shaft 82 is an enlarged diameter collar 104 of circular cross-section, against the inner side of which abuts one end of a compression spring 106 encircling the shaft, the opposite end of the spring abutting against the inner race 96 to bias the shaft axially outwardly from the end of the roller 52. To prevent the stub axle 56 from being completely withdrawn from the roller 52, the inner end 86 of the shaft 82 has a disc shaped stop 108 formed thereon which has a diameter larger than that of the inner surface 92 of the support block 88 and which will abut against the block to prevent the shaft 82 from being removed.

When installed in the frame 58, the stub axle 56 projects outwardly through the slots 80 in the flanges 72 with the collar 104 frictionally engaged against the flange under the bias of the spring 106. To insure that the collar 104 does not slip against the flange 72 and allow the roller 52 to come off the flange, a circular recess 110 having a diameter substantially equal to that of the collar is formed in the flange adjacent the closed end of the slot 80. In order to remove the roller 52 from the frame 58, all that is necessary is to depress the outer end 84 of one of the stub axles 56, as indicated by the arrow 112 of FIG. 5, and move the stub axle to the phantom line position shown to release the collar 104 from the recess 110, and then slide the shaft 82 outwardly along the slot 80 until the roller is free of the frame.

To prevent marking and marring of the freshly printed sheet 12 during operation of the press 14, the shell 54 of each of the rollers 52 is made as a right circular cylinder, preferably of metal or plastic, having a continuous outer peripheral surface 114 coated with a low-friction, self lubricating material such as polytetrafluoroethylene, and is loosely covered with a fabric material 116, such as is more particularly described in the above noted DeMoore Pat. No. 4,402,267. In accordance with another important aspect of the present invention, the fabric covering 116, which preferably is made of a loosely woven material such as cheesecloth and impregnated with a liquid repellant substance such as that sold under the trademark "Scotchguard" manufactured by the 3M Company of Minneapolis, Minnesota, is formed as a seamless cylindrical-shaped sleeve having open ends 118, and which can be quickly and easily slipped over the roller shell 54 for removal and replacement.

To releasably attach the fabric sleeve 116 to each roller 52, the ends 118 of the sleeve are folded over the ends of the shell and pressed inside the shell, preferably against a fastener strip 120 such as that sold under the trademark VELCRO, disposed around the inner periphery of the shell adjacent the ends. The fasteners 120 grip and hold the fabric sleeve ends 118, and end caps 122, herein formed as cup shaped members having enlarged radial flanged outer ends 124 and bottoms 126 formed with a central opening 128 for receiving the stub axle 56 therethrough, are press fit into the ends of the shell 54 to firmly clamp the ends of the fabric within the shell. With this arrangement, should it be necessary to replace the fabric sleeve 116 of a roller 52, such as may be required if the fabric has become soiled or torn, all that is necessary is that the roller be removed from the frame 58 and the end caps 122 pulled from the ends of the shell 54. The sleeve 116 can them be pulled from the fastener 120, slid off the roller 52 and a new sleeve pulled over the shell 54 and the ends inserted into the ends of the shell and secured against the fasteners 120 with the end caps 122. The roller 52 with the new sleeve 116 can then be quickly and simply replaced in the frame 58 and the press 14 is ready for continued use.

With the transfer device 10 of the present invention, it has been found that marking and marring of freshly printed sheets is substantially eliminated. Due to the free rotation mounting of the rollers 52 to the frame 58, any difference in the speed of rotation of the transfer device 10 relative to the impression cylinder 26 is automatically compensated by rotation of the roller relative to the frame. Thus, as a freshly printed sheet 12 is pulled from the impression cylinder 26 into engagement with a roller 52, the sheet wall immediately attached to the fabric covering 116 and the roller can rotate about its stub axles 56 to prevent any relative movement of the sheet with respect to the fabric covered surface of the shell 54, thereby preventing marking and marring of the wet ink sheet surface. Moreover, since the rollers 52 extend across the full width of the sheet 12, uniform and effective support for the sheet over a substantial area of contact is provided.

In FIG. 6 is illustrated a modified frame 68' for supporting four rollers 52 in a transfer device 10 of the invention, parts of the modified frame having a common function with those of the frame 68 of the embodiment shown in FIGS. 3–5 being designated by corresponding primed reference numerals. As shown in FIG. 6, the modified frame 58', which has an elongated generally C-shaped appearance including an elongated channel 64' formed by elongated side walls 60' and a bottom wall 62', has a pair of end plates 66' (only one of which is shown), and which permit two rollers 52 to be releasably mounted to each flange 72'. The flange 72' project outwardly from opposed sides of the channel 64' within which the drive shaft 34 is mounted, and include four elongated slots 80' for receiving and retaining the stub axles 56 of the rollers 52, each pair of slots in one flange being diametrically opposed across the drive shaft 34 from the corresponding slots in the other flange. With this embodiment, sufficient space is still provided for passage of the gripper bar 40 each one and one half revolutions of the drive shaft 34, but more support area is provided for the sheet 12 since four fabric covered rollers 52 will engage and support the sheet during each revolution of the transfer device 10.

From the foregoing, it should be apparent that the new and improved transfer device 10 of the present invention can be quickly and easily installed in the delivery system of presses 14 of the type having a one and one half to one delivery system in place of the prior art skeleton wheels 32 with out requiring press modification, and when so installed, will provide uniform support for freshly printed sheets 12 over a broad area of contact yet substantially prevent marking and marring of the wet ink. Further, with the transfer device 10 of the present invention, it will no longer be necessary to stop the press 14 to adjust the position of skeleton wheels 32, and the press can be operated continuously with out danger of marking or marring regardless of the type of print job being done. Should it become necessary to replace a fabric covering 116 on any roller 52, replacement can be quickly and easily accomplished with out requiring the press 14 to stopped for prolonged periods of time.

As illustrated herein, the axes of the rollers 52 are aligned along a diametrical plane passing through the center of the axis of rotation of the drive shaft 34, and the rollers are spaced outwardly from the side walls 60 of the frame a distance sufficient to permit the rollers to freely rotate about their stub axles 56. It should be appreciated that although two and four roller embodiments have been herein illustrated, the transfer device 10 of the present invention may employ additional rollers by appropriately modifying the end plates 66 for support of additional rollers, the critical parameters being that the axis of rotation of each roller be parallel with the axis of rotation of the drive shaft 34, and that the spacing of the rollers about the frame 58 be sufficient to permit the gripper bars 40 to pass between the rollers adjacent the impression cylinder 26.

While particular form of the present invention have been illustrated and described, it should be appreciated that various modifications and variations therein may be made without departing from the spirit and scope of the invention.

I claim:

1. In combination with a sheet-fed rotary printing press having an elongated impression cylinder for printing one side of a sheet with ink; and a one and one half to one delivery system for transferring a printed sheet from the impression cylinder to a further processing station of the press, said delivery system including:

an elongated drive shaft extending parallel to said impression cylinder;

a pair of sprocket wheels mounted for rotation to said press and coupled to the lateral ends of said drive shaft;

a pair of endless and parallel conveyor chains, one trained about each of said sprocket wheels;

a plurality of elongated gripper bars coupled to said chains at spaced locations therealong and extending laterally therebetween parallel with said drive shaft;

a plurality of grippers laterally spaced along said gripper bar and operable to engage the leading edge of a sheet at the impression cylinder and pull said sheet from the impression cylinder, said gripper bars being positioned along said gripper chain such that said drive shaft and said sprocket wheels make one and one half complete revolutions between passage of each gripper bar; and a transfer device for engaging and supporting the wet ink side of said sheet pulled from said impression cylinder by said grippers, said transfer drive comprising a frame drivingly coupled to said drive shaft and at least two elongated cylindrical rollers mounted to said frame and projecting radially outwardly of said drive shaft, said rollers being mounted for free rotation about axes extending parallel to said drive shaft and disposed to engage and support said wet ink side of said sheet during said transfer.

2. A transfer device as set forth in claim 1 wherein each of said rollers is releasably mounted to said frame.

3. A transfer device as set forth in claim 2 wherein each of said rollers comprises a generally hollow, cylindrical shell having open ends and axle means for supporting said shell to said frame, said shell being coupled with said axle means by bearing means for permitting said shell to rotate freely with respect to said axle means.

4. A transfer device as set forth in claim 3 wherein the outer surface of said shell is coated with a low friction material and is covered by a fabric material impregnated with a liquid repellant substance.

5. A transfer device as set forth in claim 4 wherein said fabric covering is formed as a seamless cylindrical sleeve having open ends.

6. A transfer device as set forth in claim 3 wherein said axle means comprises a pair of stub axles having inner end portions disposed within said shell and outer end portions projecting outwardly from each end of said shell, the inner end portions being journaled through said bearing means and axially shiftable between extended and retracted positions relative thereto such that the outer end portions can be retracted inwardly with respect to said shell for release of said roller from said frame.

7. A transfer device as set forth in claim 6 wherein said bearing means comprises an inner bearing race surrounding said inner end portion of each of said stub axles and an outer bearing race coupled to said shell, said inner and outer bearing races being coupled by bearing elements for relative rotation.

8. In a sheet fed rotary printing press of the type having an impression cylinder for printing one said of a sheet with wet ink, and a one and one half to one delivery system for transferring the printed sheet from the impression cylinder to another processing station within the press, the delivery system including a transfer device driven by a drive shaft disposed adjacent the impression cylinder, and operating to engage and support the wet ink side of the printed sheet during the transfer, said transfer device comprising:

a frame drivingly coupled to said drive shaft and at least two elongated cylindrical rollers releasably mounted to said frame on diametrically opposed sides of said drive shaft, said rollers being mounted for free rotation about axis extending parallel to said drive shaft and disposed to engage and support said wet ink side of said sheet during said transfer, each of said rollers comprising a generally hollow, cylindrical shell having open ends and axle means for supporting said shell to said frame, said shell being coupled with said axle means by bearing means for permitting said shell to rotate freely with respect to said axle means; and said axle means further comprising a pair of stub axles having inner end portions disposed within said shell and outer end portions projecting outwardly form each end of said shell, the inner end portions being journaled through said bearing means and axially shiftable between extended and retracted positions relative thereto such that the outer end portions can be retracted inwardly with respect to said shell for release of said roller from said frame.

9. A transfer device as set forth in claim 8 wherein each of said stub axles is spring biased toward the extended position.

10. A transfer device as set forth in claim 9 wherein each of said rollers is covered with a fabric material.

11. A transfer device as set forth in claim 10 wherein said fabric is a loosely woven cloth impregnated with a liquid repellant substance, and is formed as a seamless cylindrical sleeve having open ends.

12. A transfer device as set forth in claim 11 wherein the open ends said fabric sleeve are folded into the ends of said shell and a pair of end caps are press fit into the ends of said shell to retain said sleeve on said shell.

13. A transfer device as set forth in claim 9 wherein said frame comprises an elongated, generally C-shaped frame extending laterally along said drive shaft, said frame having lateral ends defining a pair of diametrically disposed mounting flanges for mounting said rollers there between.

14. A transfer device as set forth in claim 13 wherein each of said mounting flanges includes an opening for receiving the outer end portion of said stub axle, said rollers being removable from said frame by retracting said outer end portion against the bais of said spring to disengage said stub axle from said opening.

15. A transfer device as set forth in claim 14 wherein two rollers are mounted to said frame.

16. A transfer device as set forth in claim 14 wherein four rollers are mounted to said frame.

17. For use in a sheet fed rotary printing press of the type including an impression cylinder for printing a sheet and a drive shaft driving a one and one half to one delivery system for transferring the printing sheet from the impression cylinder to another processing station within the press, a transfer device comprising:

a frame mounted to said drive shaft;

at least two rollers releasably supported by said frame and arranged to engage and support said printed sheets during said transfer, each of said rollers comprising an elongated cylindrical shell formed to have a continuous outer peripheral surface and open ends, said rollers each being mounted to said frame for free rotation about axes parallel to said drive shaft and supported by bearing means for free rotation about a pair of stub axles lying along said axes, said stub axles projecting outwardly from said ends of said shell and being releasably coupled to said frame;

a fabric material covering said outer peripheral surface of each of said rollers, said fabric material being a loosely woven cloth impregnated with a liquid repellant substance and formed as a seamless cylindrical sleeve having open ends, said open ends of said sleeve being inserted into said open ends of said shell; and end caps releasably press fit within said open ends of said shell to retain said sleeve on said shell.

18. In combination with a sheet fed rotary printing press of the type including an elongated impression cylinder for printing one side of a sheet with wet ink, a one and one half to one delivery system for transferring the printed sheets from the impression cylinder to another processing station within the press, said delivery system including an elongated drive shaft extending parallel to said impression cylinder and supporting a transfer device, said transfer device comprising:

a frame mounted to said drive shaft, and at least two elongated rollers releasably supported by said frame and arranged to engage and support the wet ink side of said printed sheet during said transfer, said rollers each being mounted to said frame on opposed sides of said drive shaft for free rotation about axes parallel to said drive shaft.

19. A transfer device as set forth in claim 18 wherein said rollers are each formed to have a continuous outer peripheral surface covered by a fabric material.

20. A transfer device as set forth in claim 19 wherein said fabric material is a loosely woven cloth impregnated with a liquid repellant substance, and is formed as a seamless cylindrical sleeve having open ends.

21. A transfer device as set forth in claim 20 wherein each of said rollers comprises an elongated cylindrical shell having open ends and supported by bearing means for free rotation about a pair of stub axles lying along said axes, said stub axles projecting outwardly from said ends of said shell and releasably coupled to said frame.

22. A transfer device as set forth in claim 21 wherein said open ends of said sleeve are inserted into said open ends of said shell and end caps are releasably press fit within said open ends of said shell to retain said sleeve on said shell.

23. A transfer device as set forth in claim 22 wherein said shell has an outer cylindrical support surface coated with a low friction material.

* * * * *